United States Patent [19]

Kaufman, Jr. et al.

[11] 4,037,071

[45] July 19, 1977

[54] METHOD AND APPARATUS FOR IMPROVED DISTRIBUTION OF MICROWAVE POWER IN A MICROWAVE CAVITY

[75] Inventors: Harold B. Kaufman, Jr., New York; John H. Moyer, Garden City; John P. McCarthy, College Point, all of N.Y.

[73] Assignee: DCA Food Industries Inc., New York, N.Y.

[21] Appl. No.: 678,253

[22] Filed: Apr. 19, 1976

[51] Int. Cl.[2] ..... H05B 9/06

[52] U.S. Cl. ..... 219/10.55 F; 219/10.55 M

[58] Field of Search ..... 219/10.55 F, 10.55 R, 219/10.55 B

[56] References Cited

U.S. PATENT DOCUMENTS

| | | | |
|---|---|---|---|
| 2,961,520 | 11/1960 | Long | 219/10.55 F |
| 3,939,320 | 2/1976 | Saad | 219/10.55 F |

*Primary Examiner*—Arthur T. Grimley

[57] ABSTRACT

A system for improving the uniformity of distribution of microwave power in a microwave cavity, includes a magnetron, a wave guide extending between the magnetron and the interior of the microwave cavity for coupling microwave power into the microwave cavity and drive means operative coupled to the wave guide to vary the direction in which microwave power is introduced into the cavity.

13 Claims, 6 Drawing Figures

FIG. 2.
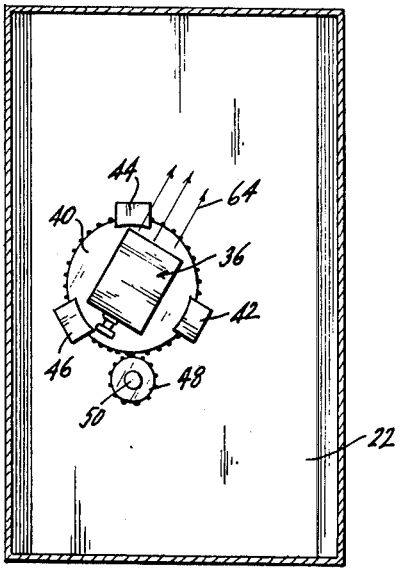
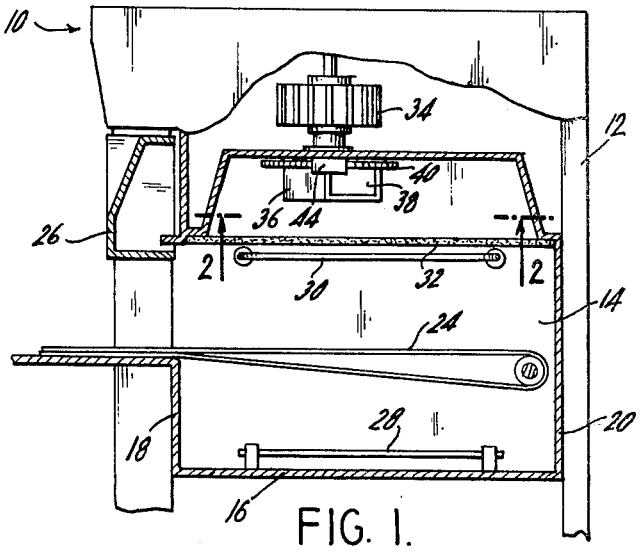
FIG. 1.
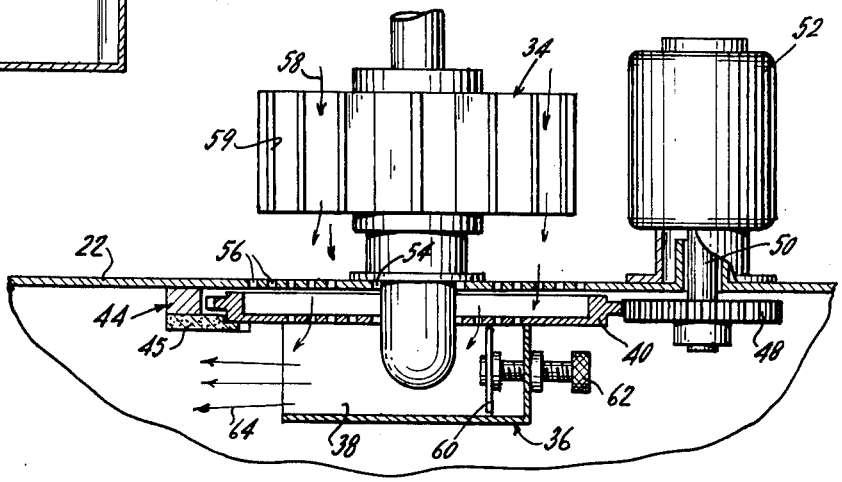
FIG. 4.
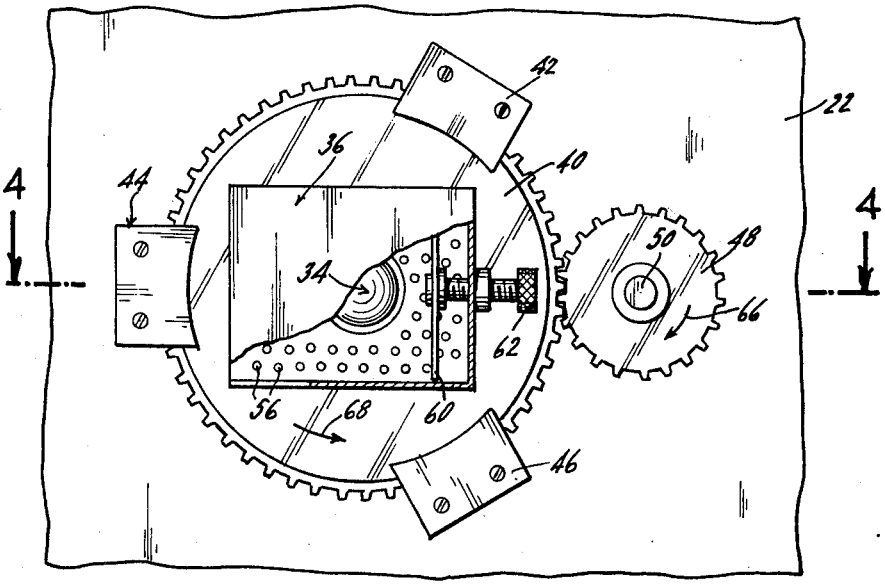
FIG. 3.

METHOD AND APPARATUS FOR IMPROVED DISTRIBUTION OF MICROWAVE POWER IN A MICROWAVE CAVITY

The invention relates to a system for improving the uniformity of microwave power distribution within a microwave cavity, and in particular, to a microwave heating device utilizing such a system.

Microwave devices, such as microwave ovens, have been in existence for sometime. In these devices, microwave power is introduced into a microwave cavity from a microwave generator, either directly or through one or more wave guides permanently affixed to and interfacing with the side, top or bottom walls of the cavity. Due to the nature of the microwave radiation and the configuration of the microwave cavity, introduction of the microwave power from a fixed source produces fixed standing wave patterns of power distribution. This results in non-uniform distribution of microwave power within the cavity producing localized areas of high and low power. This non-uniform power produces relative hot and cold areas and non-uniform heating of food in the cavity.

In an attempt to overcome this problem and provide a uniform distribution of microwave power within a microwave cavity, so called mode-stirrers have been used. An example is shown in U.S. Pat. No. 3,265,780, in which blades mounted on a sleeve surrounding an antenna are continuously rotated within the cavity to change the microwave standing wave pattern. Other examples include rotating blades (U.S. Pat. No. 3,692,967), a rotating plate (U.S. Pat. No. 2,909,,635), rotating slotted discs (U.S. Pat. No. 3,746,823), or rotating cylinders (U.S. Pat. No. 3,439,143). None of these devices have proven to be entirely successful in providing uniform distribution of microwave energy within the microwave cavity.

Accordingly, it is an object of this invention to overcome the deficiencies in the prior art systems and provide a system for promoting the uniform distribution of microwave power within a microwave cavity.

It is a still further object of the invention to provide such a system in which introduction of microwave power into the cavity can be selectively regulated.

In accomplishing these and other objects of the present invention, a microwave oven has a source of microwave power, a microwave cavity and a wave guide for coupling microwave power from the microwave source to the microwave cavity. The wave guide has a microwave outlet port which communicates with the interior of the microwave cavity and is mounted so that the orientation of the outlet port of the wave guide within the microwave cavity can be selectively varied to change the direction in which microwave energy is introduced into the microwave cavity. As a result, the effective distance of microwave travel between the outlet port and the cavity walls change, causing a continuous variation in the standing wave pattern in the cavity thereby reducing or eliminating hot spots due to a more uniform distribution of the microwave power within the cavity.

In one embodiment of the invention, the source of microwave power is mounted so that at least a portion thereof extends within the microwave cavity. In a second embodiment of the invention, the microwave power source is mounted completely external to the microwave cavity, and the wave guide extends from the source of microwave energy into the microwave cavity. In either embodiment, the closed end of the wave guide is preferably provided with a tuning stub for controlling the overall length of the wave guide and thereby controlling the effective coupling of microwave power into the cavity.

Further objects, features and advantages of the present invention will be apparent from the following detailed description of preferred but nonetheless illustrative embodiments in accordance with the present invention, when taken in conjunction with the appended drawings wherein:

FIG. 1 is a side elevation, partially broken away and partially in section showing a microwave oven including a microwave cavity and particularly showing one embodiment in which a source of microwave power extends substantially into the microwave cavity;

FIG. 2 is an enlarged cross-sectional view taken along lines 2—2 of FIG. 1 in the direction of the arrows and showing the orientation and mounting of the wave guide within the microwave cavity.

FIG. 3 is an enlarged detail view of a portion of FIG. 2 partially cut away showing the microwave source, wave guide and drive system for changing the orientation of the wave guide within the cavity.

FIG. 4 is an enlarged cross-sectional view taken along line 4—4 of FIG. 3 in the direction of the arrows and showing the microwave source and wave guide mounting and drive system in greater detail;

Figure 5:
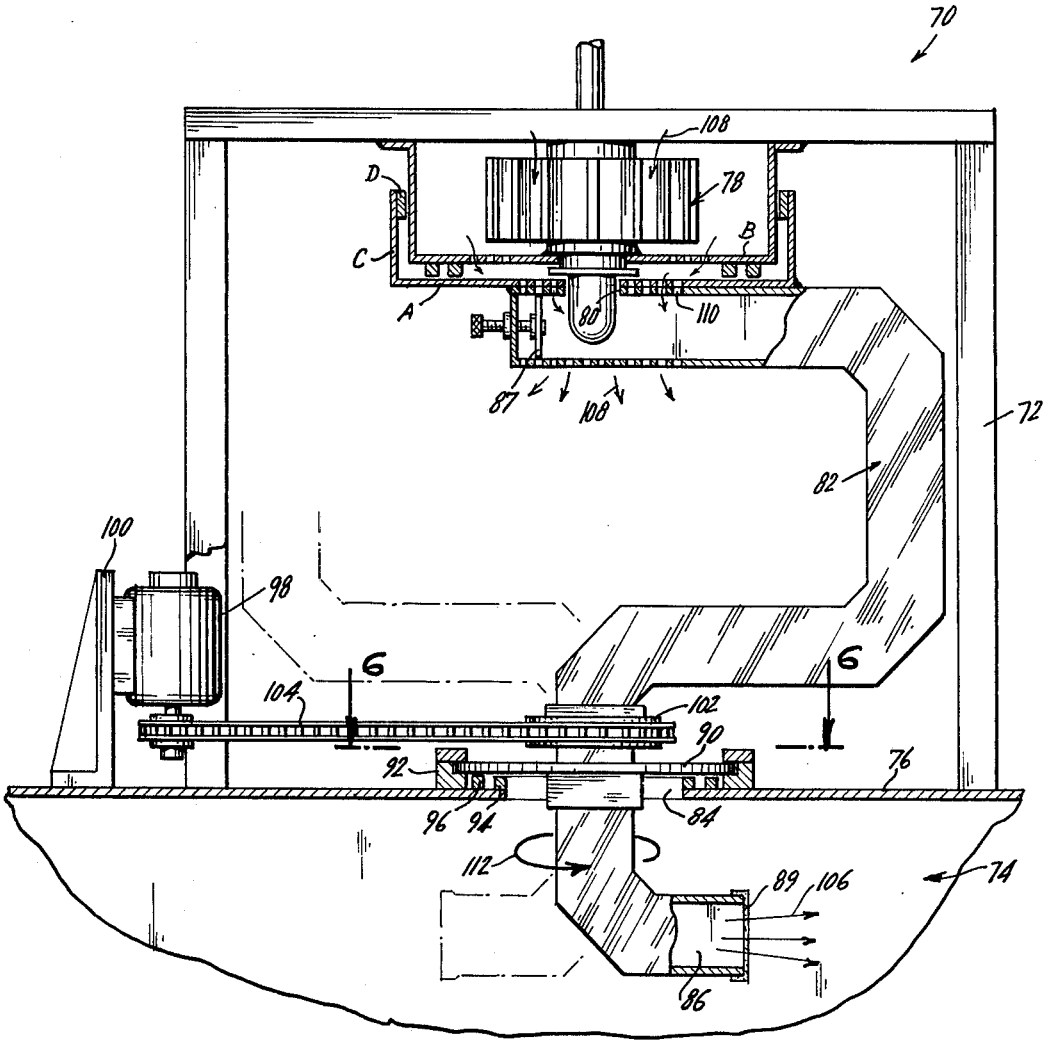
FIG. 5 is a side elevation, partially broken away and partially in section showing a second embodiment of the invention in which the source of microwave power is mounted externally of the microwave cavity and a wave guide extends from the microwave power source to the interior to the microwave cavity.

Referring now to FIG. 1 and 2, there is shown a microwave oven, generally designated by reference numeral 10, having a structure 12 supporting a microwave cavity 14 having a bottom wall 16, front and rear side walls 18 and 20, and a top wall 22. A conveyer belt 24 extends through a port in the front side wall 18 from a product loading station into the microwave cavity for transporting food into and out of the cavity for processing. The opening in side wall 18 is selectively sealed by severable end trap 26 to prevent leakage of microwave energy during food processing. Infra-red heating elements 28, 30 are mounted within the cavity which also has a shield 32 which permits the passage of microwave power into the cavity but serves as a thermal barrier.

Mounted to top wall 22 of the microwave cavity is a source of microwave power, such as a magnetron, generally designated by reference numeral 34. Wave guide 36 rotatably mounted in the microwave cavity having microwave outlet port 38 substantially encloses the portion of the magnetron which extends into the microwave cavity. Microwave power is thus coupled from the magnetron, through the wave guide and wave guide outlet port to the interior of the microwave cavity. By rotating the wave guide, the orientation of the wave guide outlet port within the cavity is changed thus varying the direction in which microwave power is introduced into the microwave cavity and the distance which microwave power travels from the outlet port to the cavity walls. As shown in FIG. 2, the wave guide and magnetron are preferably mounted "off center" to enhance this effect. In this manner, the direction of microwave power within the cavity changes promoting more uniform power distribution and product heating.

Referring now to FIGS. 3 and 4, mounting of the magnetron, wave guide and drive systems are shown in greater detail. As shown, wave guide 36 is mounted to the underside of wave guide mounting ring 40 which is supported by three mounting brackets 42,44,46, spaced apart and secured to top wall 22 by, for example, screws. The brackets preferably include a teflon or other low friction seat 45 which supports the wave guide mounting ring for rotation within the microwave cavity. The periphery of the mounting ring is formed with a plurality of gear teeth which mesh with drive gear 48 mounted on shaft 50 of drive motor 52.

Magnetron 34 extends into microwave cavity 14 through magnetron entry port, generally designated by reference numeral 54 in top wall 22 and mounting ring 40. Top wall 22 and mounting ring 40 are also provided with air holes 56, so that cooling air, generally shown by arrows 58 can circulate past cooling fins 60 surrounding magnetron 34. The holes are dimensioned to prevent the escape of microwave power from the cavity as is well known. Wave guide 36 also includes an adjustable tuning plate 60 which is slideable mounted within the closed end of the wave guide and positioned by adjustment screw 62 for optimum coupling of microwave power into the cavity. The adjustment of the tuning plate which is dependent in part upon the dimensions of the wave guide and magnetron output can be determined as is well known in the art. In a typical microwave oven, the magnetron operates at a frequency of 2450 Mhz and power output of 1.0 kwatts. The cross-sectional dimension of the wave guide are 3.4 wide × 1.7 high.

In operation, food to be processed is loaded onto conveyer 24 and transported into microwave cavity 14. Severable end trap 26 is lowered to seal the cavity and power is supplied to the magnetron which emits microwave power into the microwave cavity through wave guide outlet pot 36 and represented by arrows 64. Motor 52 is activated to drive gear 48 in the direction of arrow 66 (FIG. 3) which in turn drives mounting ring 40 and wave guide 36 in the direction of arrow 68 (FIG. 4) Rotation of the wave guide results in a continuing change in the orientation of the wave guide outlet port in the microwave cavity producing changes in the distribution of the microwave power in the cavity thereby promoting more uniform distribution of microwave power pattern within the cavity and more uniform heating with improved processing of food products.

Figure 6:
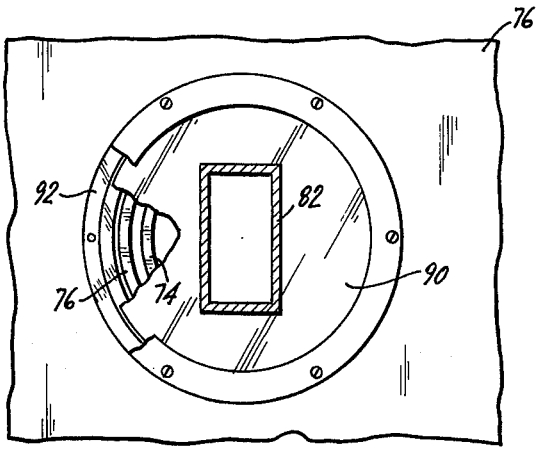
FIG. 6 is an enlarged cross-sectional view partially broken away and taken along line 6—6 of FIG. 5 in the direction of the arrows and showing a microwave seal for preventing leakage of microwave energy from the microwave cavity.

Uniform microwave power distribution in a microwave cavity can also be provided in a microwave system in which the magnetron is mounted outside the microwave cavity. Such a system is shown in FIGS. 5 and 6 wherein a microwave oven 70 includes a structure 72 mounting a microwave cavity 74 having a top wall 76. A magnetron 78 is appropriately mounted on the structure and extends through a magnetron inlet port 80 in wave guide 82. Wave guide 82 mounted on the structure extends through a wave guide inlet port 84 in top wall 76 into the microwave cavity 74 and has a microwave outlet port 86 for coupling energy from the magnetron to the microwave cavity. In addition, a tuning stub generally designated by reference numeral 87 is mounted at the closed end of wave guide 82 to provide optimum coupling of microwave power to the microwave cavity as described above. A plastic shield 89 impervious to infra-red energy but which allows the passage of microwave power is fixed to the wave guide outlet port to prevent heat from damaging the magnetron.

In order to prevent microwave leakage from the magnetron inlet port 80 circular disc A is attached on top of the wave guide and rotates concentrically therewith. Cyclindrical member C is attached to disc A and contains a bearing ring, D to insure concentric positioning of disc A around the magnetron. Circular disc B with concentric annular choke rings, is sealed around the magnetron housing to prevent microwave leakage therefrom. It does not rotate.

Mounted on top wall 76 to prevent leakage of microwave energy through port 84 is a microwave choke generally designated by reference numeral 88 which includes disc 90 supported in circular bracket 92 mounted on the top wall. A pair of concentric annular rings 94, 96 with rectangular cross-sections encircling the wave guide inlet port 84 are spaced and dimensioned to form the microwave choke which is well known to the art.

Rotation of wave guide 82 is produced by drive motor 98 mounted on bracket 100 and connected to the drive pulley 102 on the wave guide by belt 104.

In operation, after food is introduced into the microwave cavity and the cavity sealed by lowering the severable end trap, power is supplied to the magnetron producing microwave power which is coupled to the microwave cavity through the wave guide outlet port 86 as represented by arrows 106. Cooling air, as represented by arrows 108, flows around the magnetron and through holes 110 in the wave guide to cool the magnetron. The drive motor is then activated which through belt 104 and pulley 102 rotates the wave guide which carries disc 90 through 360° rotation as indicated by arrows 112 and represented by the dotted and full line position of the wave guide. Rotation of the disc maintains a microwave seal over port 84 and port 80 and rotation of the wave guide changes the orientation of the wave guide outlet port in the microwave cavity achieving and promoting more uniform distribution of microwave power therein.

While there has been shown presently preferred embodiments of the invention, it will be understood, of course, that various changes and modifications may be made in the form, details, arrangement and proportions of the parts without departing from the spirit and scope of the invention. For example, as an alternative to continuous rotation of the wave guide, a uniform microwave power distribution within the microwave cavity can also be achieved by a programmed rotation of the wave guide based upon an experimental determination of the microwave distribution in a particular microwave cavity. This experimental determination can be made, as is known in the art, as follows:

a. heat sensitive paper is placed at various points in the microwave cavity;

b. the wave guide is manually rotated and stopped at precisely controlled regular intervals over its 360° sweep;

c. standing waves and the resulting hot spots are determined and analyzed by the exposure pattern on the heat sensitive paper;

d. from this analysis, the optimum combination of wave guide positions and rotation speeds is selected.

Thus, it may be determined that instead of being rotated through 360°, it may be necessary to rotate the wave guide reciprocally through a lesser angle.

What I claim is:

1. A system for distribution of microwave power within a microwave cavity, comprising a source of microwave power, a wave guide coupled to receive microwave power from said source of microwave power and having a microwave outlet port adapted to communicate with the interior of the microwave cavity for introducing microwave power into the interior thereof and means operatively coupled to said wave guide for selectively varying the orientation of the outlet port of said wave guide within said microwave cavity so that the direction in which microwave power is introduced into said microwave cavity can be controlled to produce a varying distribution of microwave power within said microwave cavity.

2. The system of claim 1 further including tuning means mounted in said wave guide for selectively adjusting the microwave power coupled into said microwave cavity.

3. The system of claim 2 wherein said wave guide includes a wave guide tuner plate assembly positioned in the wave guide and selectively adjustable for optimum coupling of microwave power into the microwave cavity.

4. A system for distribution of microwave power within a microwave cavity comprising, a source of microwave power, means mounting said source of microwave power so that a substantial portion of said source of microwave power extends into said microwave caivity, a wave guide having a microwave outlet port communicating with said microwave cavity positioned in said microwave cavity substantially enclosing the portion of said source of microwave power extending into said microwave cavity for conveying microwave power from said microwave source into said microwave cavity through said microwave outlet port, means operatively coupled to said wave guide for selectively varying the orientation of the outlet port thereof within said microwave cavity to control the direction in which microwave power is introduced into said cavity and produce a varying distribution of microwave power within said microwave cavity.

5. The system of claim 4 further including tuning means mounted in said wave guide for selectively adjusting the microwave power coupled into said microwave cavity.

6. The system of claim 5 wherein said wave guide includes a wave guide tuner plate assembly positioned in the wave guide and selectively adjustable for optimum coupling of microwave power into the microwave cavity.

7. A system for distribution of microwave power within a microwave cavity comprising, a source of microwave power positioned outside said microwave cavity, a wave guide having a microwave outlet port communicating with the interior of said microwave cavity coupled to receive and convey microwave power from said microwave source into said microwave cavity through said microwave outlet port, means operatively coupled to said wave guide for selectively varying the orientation of the wave guide outlet port within said microwave cavity to control the direction in which microwave power is introduced therein and produce varying distribution of microwave power within said microwave cavity.

8. The system of claim 7 wherein said wave guide extends from said microwave source through a wave guide inlet port in said cavity to the interior of said cavity and wherein said system further includes choke means cooperatively disposed in relation to said wave guide inlet port to prevent leakage of microwave power from said wave guide inlet port.

9. The system of claim 8 wherein said choke means includes at least a pair of concentric annular rings mounted on said housing encircling said wave guide inlet port and an annular disc mounted on said housing overlaying said annular rings and having an opening for passage of said wave guide.

10. The system of claim 9 wherein said disc is secured to said wave guide and mounted for movement with said wave guide.

11. The system of claim 7 wherein said wave guide further includes a microwave inlet port coupled to said source of microwave power and microwave choke means cooperatively disposed in relation to said microwave inlet port and said source of microwave power to prevent leakage of microwave power from said microwave inlet port.

12. A method for distribution of microwave power within a microwave cavity, comprising the steps of conveying microwave power from a microwave source through a wave guide to the interior of the microwave cavity, varying the orientation of the wave guide to control the direction in which microwave power is introduced into said microwave cavity and produce a varying distribution of microwave power within said microwave cavity.

13. A microwave oven for processing of food products comprising a housing, a source of microwave power mounted in said housing and a microwave cavity formed in said housing having a selectively sealable port therein for receiving food products to be processed, a system for distribution of microwave power within said microwave cavity including a wave guide having a microwave outlet port communicating with the interior of said microwave cavity coupled to receive and convey microwave power from said source of microwave power into the interior of said microwave cavity through said microwave outlet port, drive means mounted on said housing operatively coupled to said wave guide for selectively varying the orientation of said microwave outlet port within said microwave cavity to control the direction in which microwave power is introduced into said microwave cavity and produce varying distributions of microwave power within microwave cavity.

* * * * *